US006492608B1

(12) United States Patent
Sun

(10) Patent No.: US 6,492,608 B1
(45) Date of Patent: Dec. 10, 2002

(54) MICROSWITCH WITH SHIFTING GEAR

(76) Inventor: Bing Sun, Room 201, No. 22, Building 7, ShuGuang Xin Cun, HangZhou, ZheJiang Province (CN)

( * ) Notice: Subject to any disclaimer, the term of this patent is extended or adjusted under 35 U.S.C. 154(b) by 0 days.

(21) Appl. No.: 09/286,965

(22) Filed: Apr. 6, 1999

(51) Int. Cl.[7] ..... H01H 3/42

(52) U.S. Cl. ..... 200/574; 200/19.2; 200/332.1; 200/568

(58) Field of Search ..... 200/573, 574, 200/332, 332.1, 568, 569, 572, 564, 19.03, 19.07, 19.13, 19.18, 19.2, 335, 47

(56) References Cited

U.S. PATENT DOCUMENTS

| | | | | |
|---|---|---|---|---|
| 2,817,725 A | * | 12/1957 | Rochfort et al. | 200/47 |
| 3,008,024 A | * | 11/1961 | Roeser | 200/332 |
| 3,257,856 A | * | 6/1966 | Parris, Jr. | 200/47 X |
| 3,406,270 A | * | 10/1968 | Sho | 200/574 X |
| 4,181,838 A | * | 1/1980 | Neuser et al. | 200/573 |
| 5,045,657 A | * | 9/1991 | Claar et al. | 200/332.1 |

OTHER PUBLICATIONS

"Oil Temperature Indicator, OTI Series 34", specification of the products of Ab Kihlstroms Manometerfabrik of Sweden—undated.

"Temperature Measuring Instruments with Analogue Output Singal 4. .20mA", Messko Albert Hauser Gmbh & Co. of Germany—Aug. 1993.

* cited by examiner

*Primary Examiner*—Renee Luebke
(74) *Attorney, Agent, or Firm*—Fish & Richardson P.C.

(57) ABSTRACT

A microswitch with shifting gear, especially suited to set indication, alarm and urgent tripping in pointer type instruments, like pressure gauge, thermometer and so on. The microswitch includes a switch unit, a pressure bar (or lever), an actuator, and a shifting gear. The shifting gear is located near one side of the pressure bar. This shifting gear includes a cam and two forks (or arms) fixed on the cam. The location of the center shaft of the cam is fixed relative to the switch unit. On a circumferential portion of the cam, there are two contact points or two contact surfaces that have unequal distances from the center of the shaft. When a striking arm hits on one of the forks, the cam will rotate and change the contact point or contact surface that contacts the pressure bar, thus the functional mode of the switch unit can be changed. The pointer-type instrument has a pointer (or indicator arm) that indicates environmental conditions such as temperature or pressure. The striking arm and the pointer are fixed on the same shaft. The striking arm will shift the switch unit on or off when the pointer passes a set point (e.g., a set temperature value). The microswitch overcomes the problem of aggregation of reactive forces from several activated switch units. The microswitch has a simple structure, is very practical, and allows the pointer-type instrument to provide good indication accuracy with no setting errors.

20 Claims, 5 Drawing Sheets

MICROSWITCH WITH SHIFTING GEAR

FIELD OF THE INVENTION

The present invention relates to an electric switch, and more particularly, to a microswitch with shifting gear to shift the switch on and off by a striking arm, which can be widely used in small current control system, such as limit system, alarm system, indicate system, etc. It is specially suited to set indication, alarm and urgent tripping in pointer type instruments, like pressure gauge, thermometer and so on.

BACKGROUND OF THE INVENTION

Microswitches are widely used in many fields, in recent times, microswitch are in general typically operated by pressing an actuator (or a button). FIG. 1 shows a typical electric contact unit used in a thermometer. As shown in FIG. 1, the indicate pointer is fixed with the cam together. When the temperature increases, the pointer turns counter-clockwise with the cam synchronously. When the temperature reaches a first set point, the cam causes the microswitch K1 to be depressed and activated because of the change of the cam's diameter. When the temperature goes up continuously, the cam will cause microswitches K2 and K3 to be depressed and activated one by one; and the cam itself is bearing the reactive force of the restoring torque from the activated microswitches. The reactive force increases when the number of the activated microswitches increases, and the damping force to the pointer becomes heavier, which will influence the accuracy of temperature indication. When the activated microswitches reach a certain quantity (usually be 2), the indication error will be more than the acceptable range in many cases. In another respect, more force moment is required at the point "O" because the reaction force from the activated microswitches will affect the pointer's rotational movement. Thus the miniaturization of the thermometer bulb is restricted.

To overcome the increasing reactive forces exerted from several microswitches, one method is to use a microswitch whose indicating pan is separated from the setting pan, and the indicating pointer is coupled to the setting pointer which activates the microswitch. Because the accuracy is influenced by both the driving device's transmission error and the setting error caused by the separation of the setting pan and indicating pan, this method requires high techniques and the quality control is difficult.

Therefore, the purpose of the invention is to provide a microswitch which includes a shifting unit that can overcome the aggregation of reactive forces from the activated switches and is easy to manufacture, the microswitch is especially suited for use in pointer type instruments.

SUMMARY OF THE INVENTION

To achieve the above object, the present invention provides a microswitch comprising a switch unit, a pressure bar, an actuator, and a shifting gear.

The switch unit, pressure bar, and actuator are the same as or similar to a typical switch.

The shifting gear is fixed near one side of the pressure bar. This shifting gear is made of a cam and two forks fixed on the cam. The center shaft of the cam is fixed relative to the switch unit by a method generally known in the art. On the side of the cam facing the pressure bar, there are two contact points or two contact surfaces which are un-equidistant from the center of the cam. When a striking arm hits on the fork, the cam will rotate about the shaft and change its contact point or contact surface that is facing the pressure bar, thereby changing the functional mode of the switch.

The striking arm and the pointer are fixed on a same shaft and the striking arm swill shift the switch on or off when the pointer rotates pass the set point.

According to the above-mentioned method, the shaft of the pointer sustains a reactive force only when the striking arm hits on the fork to shift the microswitch on or off. The problem of aggregated pressure is overcome. Therefore, the pointer has a high indication accuracy and requires less force moment from the thermometer bulb. The structure of present invention is very simple, has no setting error, and is very practical.

DETAILED DESCRIPTION OF THE PREFERRED EMBODIMENTS

Figure 1:
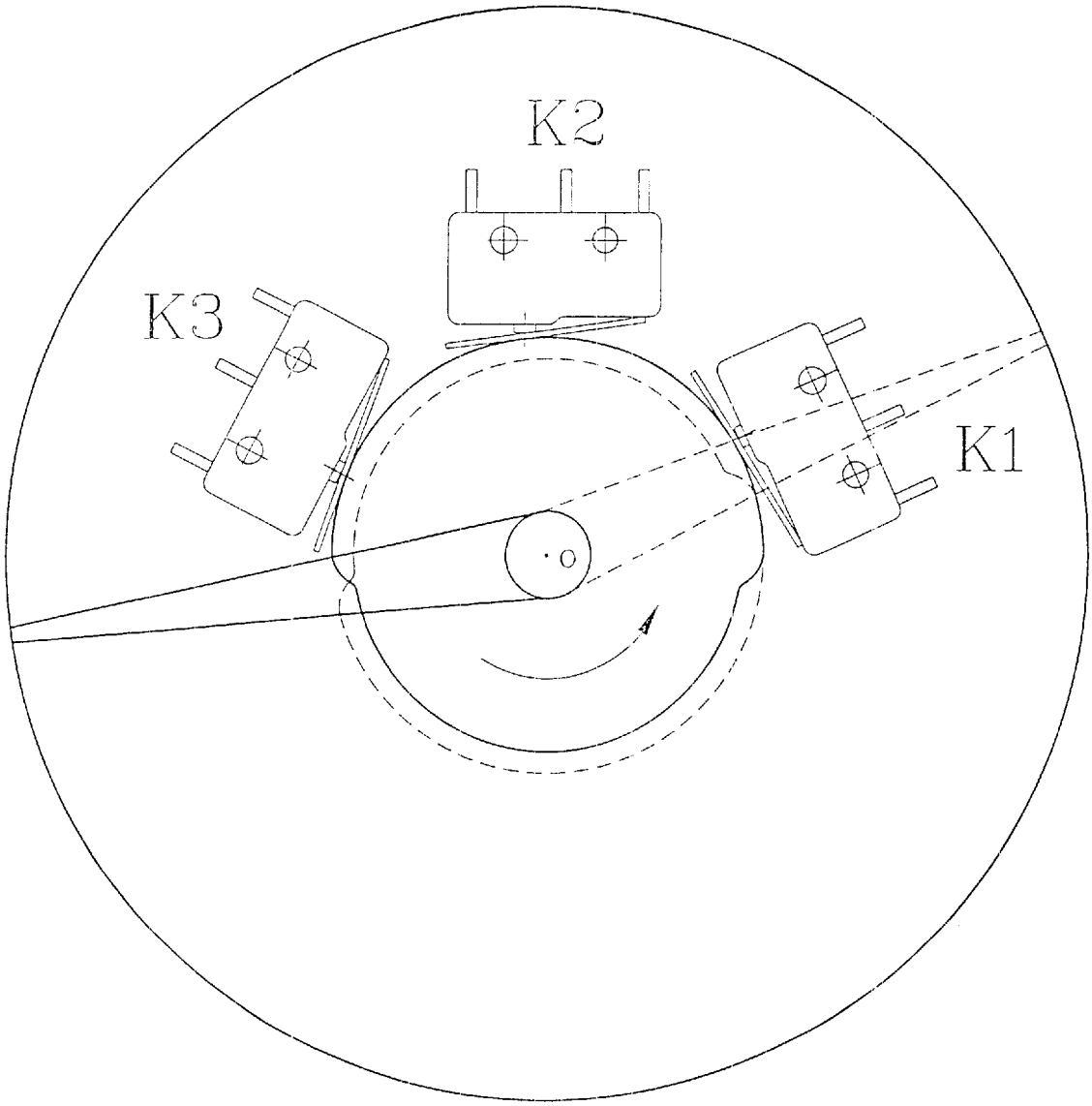
FIG. 1 (PRIOR ART )
FIG. 1 is the schematic view of a typical microswitch applied in a pointer-type instrument.

Preferred embodiments of the present invention will now be described in detail with reference to the accompanying drawings.

Referring to FIG. 2, FIG. 3, FIG. 4 and FIG. 5, drawing reference numerals are described as follows:

| | |
|---|---|
| 1—left fork | 2—striking arm |
| 3—right fork | 4—cam |
| 5—center shaft of the cam 4 | 6—pressure bar |
| 7—switch unit | 8—actuator |
| 9—pointer | 90—shaft of pointer |

Figure 2:
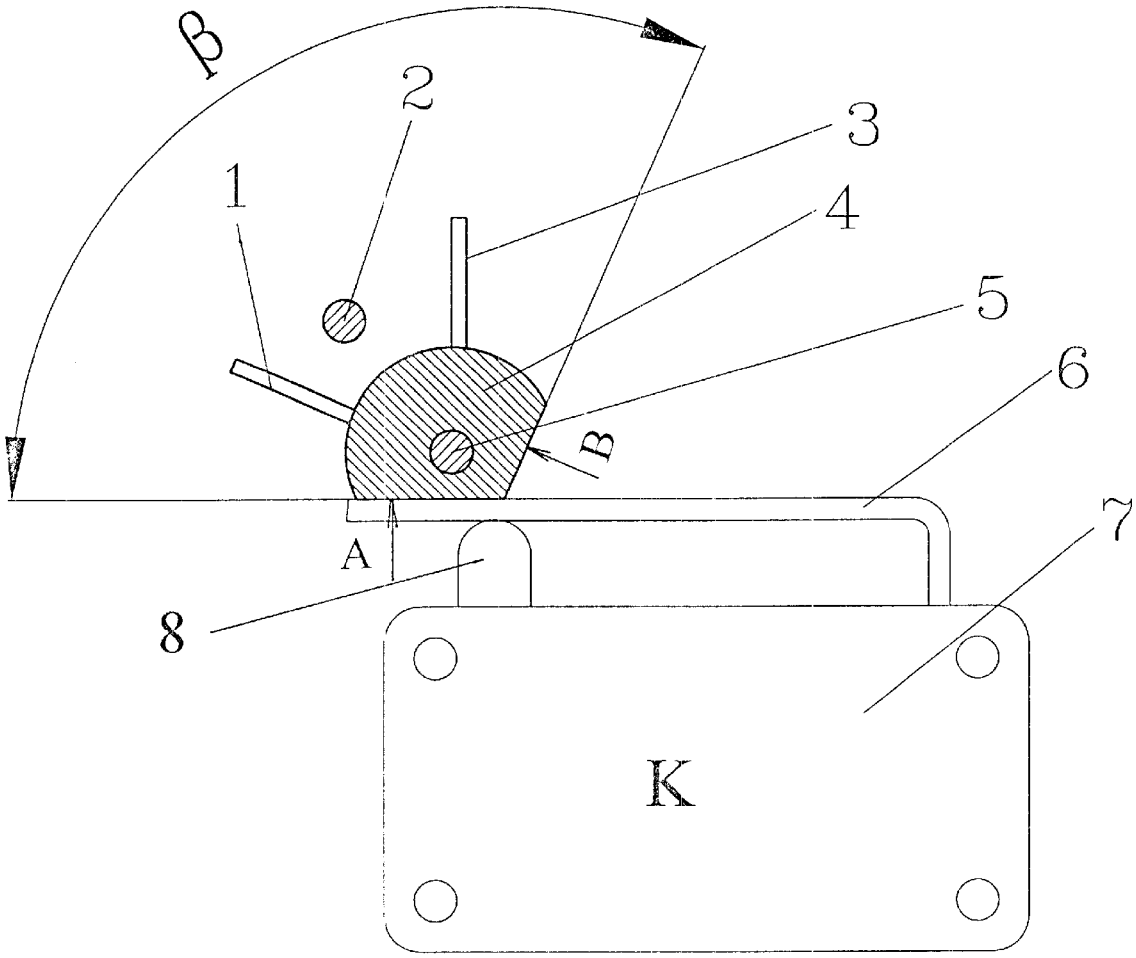
FIG. 2 is the schematic view of the structure of the present invention when the microswitch is not activated.
Figure 3:
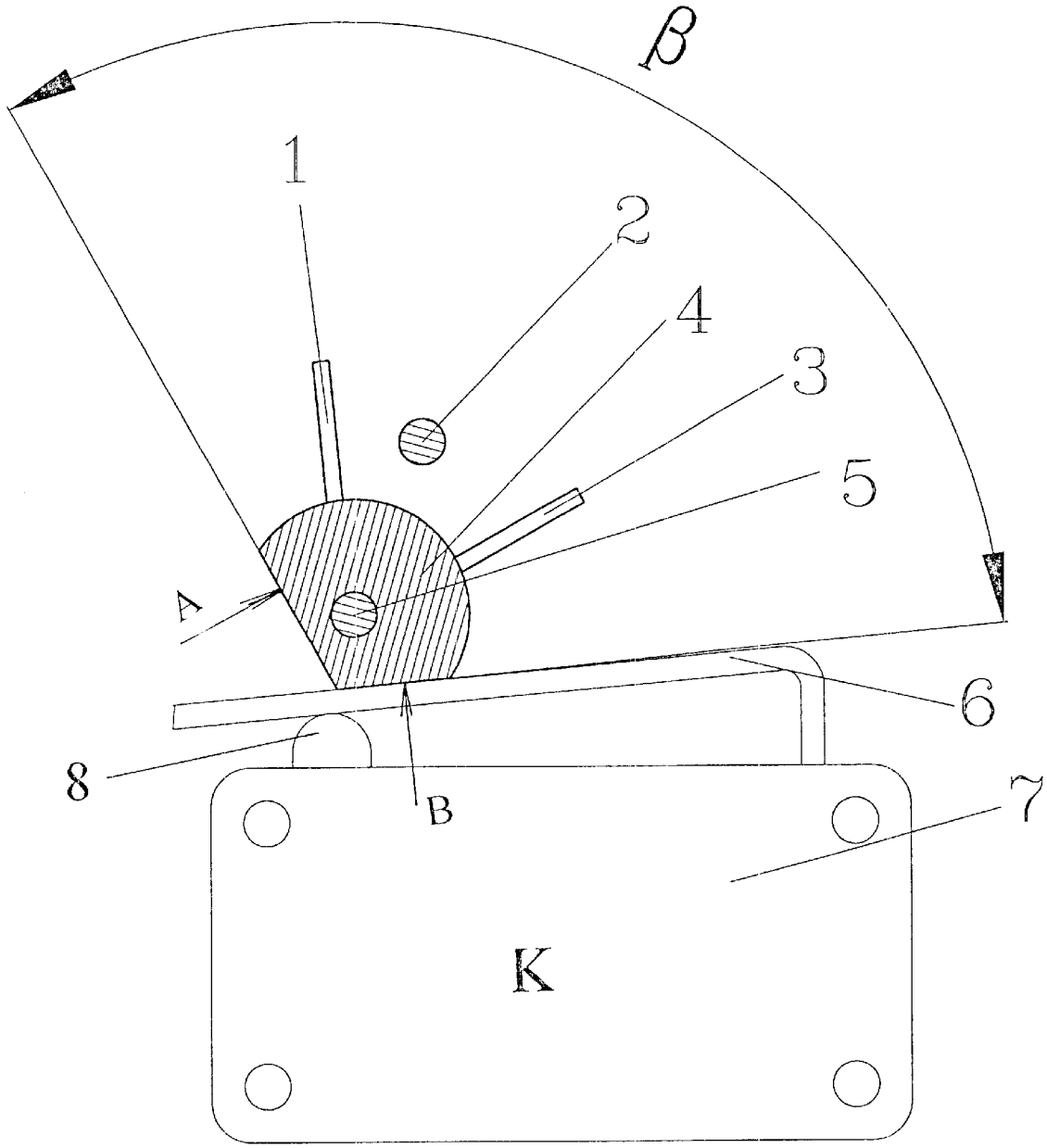
FIG. 3 is the schematic view of the structure of the present invention when the microswitch is activated.

FIG. 2 and FIG. 3 show the structure of the present invention when the microswitch is inactivated and activated, respectively.

Referring to FIG. 2, the switch unit 7 has a pressure bar 6 (or lever) and an actuator 8. The actuator 8 touches the underside of the pressure bar 6 but is not pressed by pressure bar 6. The cam 4 is disposed at the upper-side of the pressure bar 6. The center shaft 5 of the cam 4 is fixed relative to switch unit 7 by a method known in the art. The cam 4 has two forks (or two arms), namely left fork 1 and right fork 3, respectively. The bottom side of the cam 4 is made up of two surfaces, surface A and surface B, which are intersecting but un-equidistant from the center shaft 5 of the cam 4. The angle between surface A and surface B is $\alpha$. The best value range of $\beta$ is from 60° to 120°, and the distance from surface B to the center shaft 5 is longer than the distance from surface A to the center shaft 5. At this time, the surface A contacts the pressure bar 6.

A microswitch is designed to be activated by a small force from a striking arm connected to an indicator arm of an instrument without influencing the accuracy of the instrument. The microswitch maintains its position after being activated without additional external force.

In one aspect, the invention is directed towards a microswitch that includes a pressure bar having a first side and a second side, an actuator, and a cam rotatably coupled to a shaft. The cam has a fork disposed near a peripheral portion of the cam. The cam has a first contact surface that intersects a second contact surface. The cam has a center and a shape such that the distances between the center of the cam to the first and second contact surfaces are different. The actuator is disposed near the first side of the pressure bar, and the cam is disposed near the second side of the pressure bar. Initially, the first contact surface is in contact with the second side of the pressure bar. When the fork is pushed to cause the cam to rotate in a clockwise direction, the first contact surface of the cam moves away from the second side of the pressure bar, and the second contact surface of the cam comes into contact with the second side of the pressure bar and pushes the pressure bar against the actuator to activate the actuator.

In another aspect, the invention is directed towards a switch assembly that includes a switch unit and a cam unit. The switch unit has a lever and an actuator. The actuator is in an inactivated state when the lever is not pushing against the actuator. The cam unit is configured to rotate about an axis. The cam unit has a first surface that does not contact the lever when the cam unit is disposed at a first position. The first surface contacts the lever and pushes the lever against the actuator to activate the actuator when the cam unit is disposed at a second position. The cam unit is positioned relative to the lever such that when the cam unit rotates to the second position, the lever pushes back against the first surface to maintain the cam unit at the second position. The cam unit is stably maintained at the second position and continues to push the lever against the actuator without requiring any additional external force.

In another aspect, the invention is directed towards an apparatus that includes an indicator arm, a striking member, and a first switch assembly. The indicator arm rotates about a first axis in response to changes in an environment condition. The striking member rotates about the fi axis synchronously with the indicator arm. The first switch assembly includes a first switch unit having a lever and a first cam unit having a first surface. The first cam is configured to rotate about a cam axis to alternate between first and second positions. The first surface of the first cam does not contact the lever so that the lever is disposed at a first position when the first cam unit rotates to the first position. The first surface contacts the lever and biases the lever into a second position when the first cam unit rotates to the second position. As the indicator arm rotates from a first position to a second position, the striking member also rotates from a first position to a second position and momentarily exerts torque force on the first cam unit to cause the first cam unit to rotate from the first position to the second position. This causes the lever to move from the first position to the second position. The first cam unit is configured to maintain the second position without any external force other than the force exerted by the lever.

The cam 4 is disposed at the upper-side of the pressure bar 6. The center shaft 5 of the cam 4 is fixed relative to switch unit 7 by a method known in the art. The cam 4 has two forks (or two arms), namely left fork 1 and right fork 3, respectively. The bottom side of the cam 4 is made up of two surfaces, surface A and surface B, which are intersecting but un-equidistant from the center shaft 5 of the cam 4. The angle between surfaces A and surfaces B is $\alpha$. The best value range of $\alpha$ is from 60° to 120°, and the distance from surface B to the center shaft 5 is longer than the distance from surface A to the center shaft 5. At this time, the surface A contacts the pressure bar 6.

The motion of the striking arm 2 (in a direction from left to right of the figure) will cause the striking arm 2 to hit on the right fork 3, and cause the cam 4 to rotate about its center shaft 5. The surface A moves away from the pressure bar 6, and the surface B comes into contact with the pressure bar 6 while the cam 4 rotates counterclockwise. Because the distance from the surface B to the cam's center shaft 5 is longer than the distance from the surface A to the cam's center shaft 5, the pressure bar 6 will press down upon the actuator 8 and activate the switch, as shown in FIG. 3.

Figure 4:
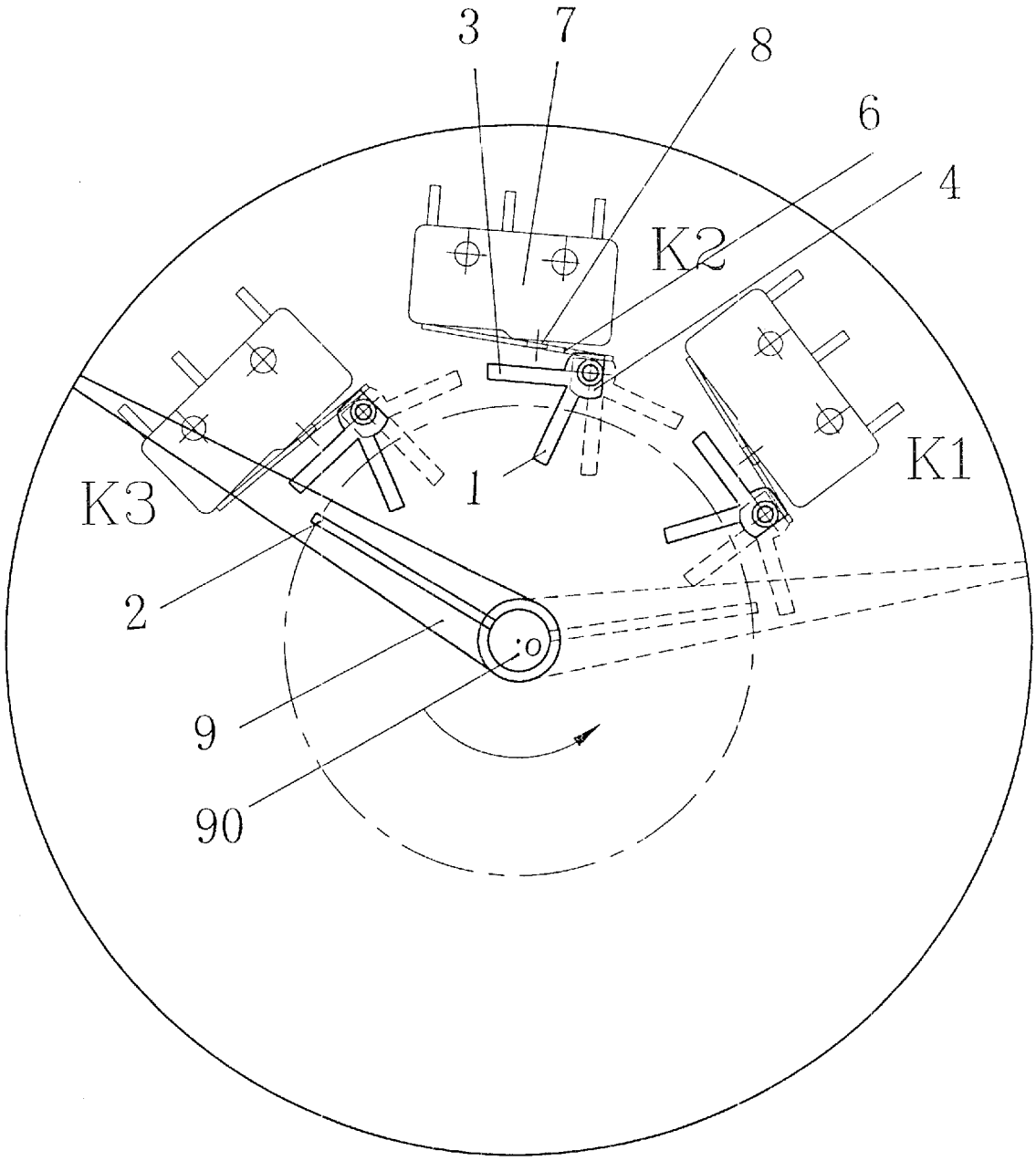
FIG. 4 is the schematic view of the present invention applied in a pointer-type instrument.

FIG. 4 is a schematic diagram of the present invention applied in a pointer-type instrument. In the drawing, dotted lines indicate the original position of the pointer (or indicator arm), and the switches K1, K2 and K3 are all in the status of non-activated. Solid lines show the pointer-reaching the highest position that can be indicated by the pointer, and the switches K1, K2 and K3 are all in the status of activated. The pointer could turn clockwise from the highest position to the original position when the environment condition changes, and shift the switches K3, K2 and K1 one by one to the status of non-activated.

Figure 5:
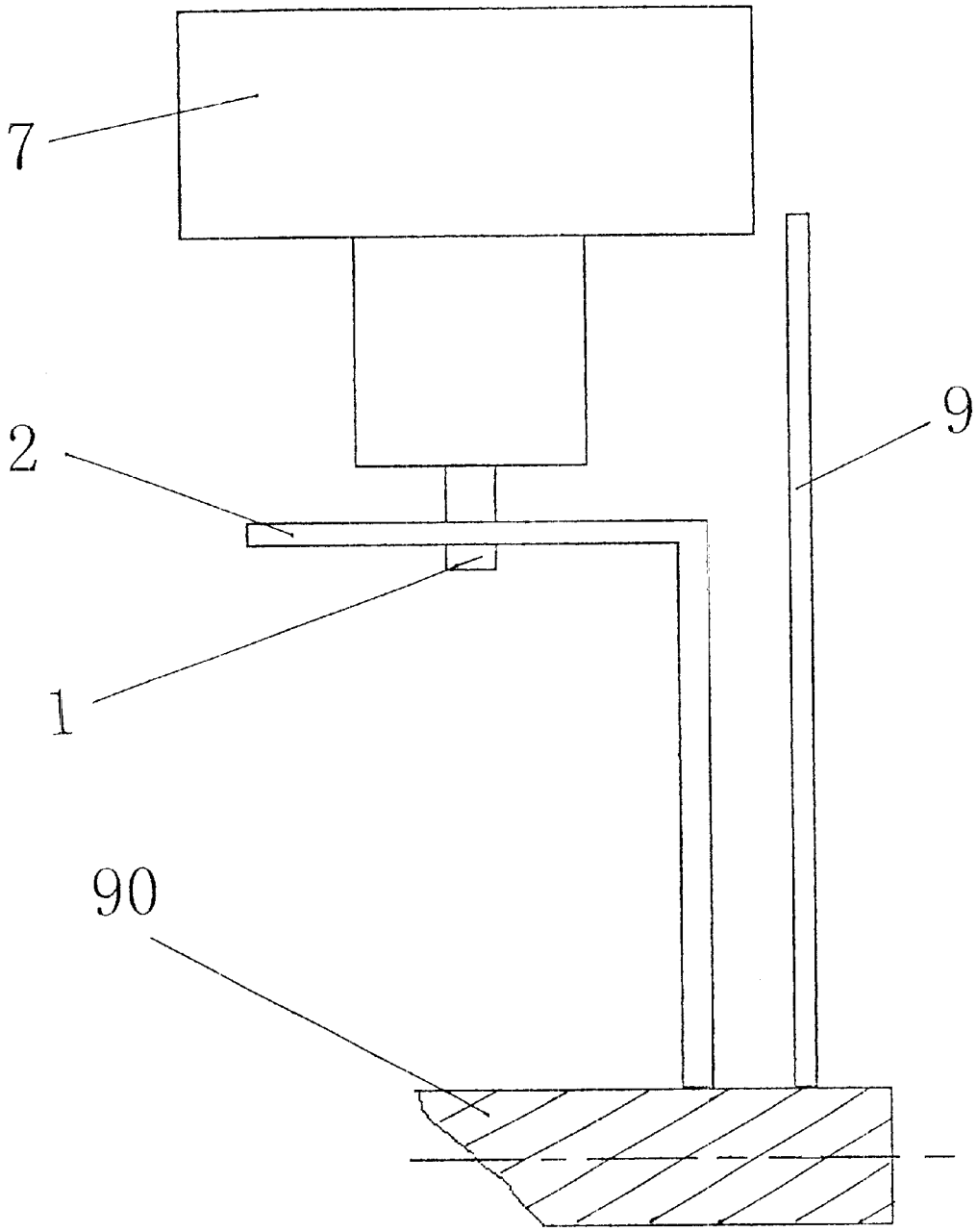
FIG. 5 is the cutaway view of the installation of the present invention applied in a pointer-type instrument.

FIG. 5 is the cutaway view of the installation of the present invention applied in a pointer-type instrument. As shown in the drawing, the striking arm 2 and the pointer 9 are fixed on the pointer shaft 90 and lie in the same shaft line. They cycle synchronously.

Combining FIG. 4 and FIG. 5, for the present invention, the pointer's shaft 90 receives reactive force only when the striking arm 2 hits on the fork 1 or 3 to shift a certain switch. After the pointer 9 passes the set point, there is no action to the shaft 90 of the pointer 9. Therefore, the accuracy of the indication by the pointer 9 is ensured. And also, the reacting force of the switches according to the present invention is only related to the force needed for the striking arm 2 to shift a switch, and has no relation with the quantity of the switches that are activated. Therefore, the quantity of switches can be increased when necessary and will not be limited if the instrument has enough inner space. Meanwhile the pointer's shaft 90 needs less input force from the thermometer, so this will allow the miniaturization of the thermometer's bulb. A contrasting experiment shows that in a certain model of thermometer that uses the electric switch unit of FIG. 1, its thermometer bulb's diameter is 18 mm. If the present invention is used, the thermometer bulb's diameter can be as small as 8 mm.

Summarizing the above-mentioned, the present invention has a simple structure, and no high technique is needed. It not only overcomes the problem of aggregation of pressure, it also decreases the force required to drive the indicator. The present invention also has good indication accuracy and strong practicality. It can be widely used in many types of small current control systems, and is especially suited for indicating preset values in pointer type instruments.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A microswitch comprising:

a pressure bar having a first side and a second side;

an actuator; and a cam rotatably coupled to a shaft, said cam having a fork disposed near a peripheral portion of said cam, said cam having a first contact surface and a second contact surface, said first and second contact surfaces intersect, said cam having a center and having a shape such that the distances between the center of said cam to said first and second contact surfaces are different;

wherein said actuator is disposed near said first side of said pressure bar, said cam is disposed near said second side of said pressure bar such that initially said first contact surface is in contact with said second side of said pressure bar, and when said fork is pushed to cause said cam to rotate in a clockwise direction, said first contact surface of said cam moves away from said second side of said pressure bar, and said second contact surface of said cam comes into contact with said second side of said pressure bar and pushes said pressure bar against said actuator to activate said actuator.

2. The microswitch according to claim 1, wherein the first and second surfaces are at an angle of about 60° to 120°.

3. A switch assembly, comprising:

a switch unit having a lever and an actuator, the actuator being in an inactivated state when the lever is not pushing against the actuator; and a cam unit configured to rotate about an axis, the cam unit having a first surface, the first surface not contacting the lever when the cam unit is disposed at a first position, the first surface contacting the lever and pushing the lever against the actuator to activate the actuator when the cam unit is disposed at a second position, the cam unit positioned relative to the lever such that when the cam unit rotates to the second position, the lever pushes back against the first surface to maintain the cam unit at the second position, wherein the cam unit is stably maintained at the second position and continues to push the lever against the actuator without requiring any additional external force.

4. The switch assembly of claim 3 wherein the first surface comprises a flat surface that engages the lever when the cam unit rotates to the second position, the flat surface and the lever pressing against one another to maintain the cam unit at the second position.

5. The switch assembly of claim 3 wherein the cam unit further comprises a second surface, the second surface contacting the lever when the cam unit rotates to the first position.

6. The switch assembly of claim 5 wherein the first surface and the second surface of the cam unit meet to form a convex shape, and the first and second surfaces are at an angle of about 60° to 120°.

7. The switch assembly of claim 5 wherein the axis and the first surface have a first distance while the axis and the second surface have a second distance, the first distance being different from the second distance.

8. The switch assembly of claim 3 wherein the actuator activates the switch unit to allow an electric current to flow when the cam unit is at the second position.

9. The switch assembly of claim 3 wherein the cam unit further comprises a first arm and a second arm such that the cam rotates to the first position when the first arm is pushed in a first direction, and the cam rotates to the second position when the second arm is pushed in a second direction.

10. Apparatus comprising:

an indicator arm that rotates about a first axis in response to changes in an environment condition;

a striking member that rotates about the first axis synchronously with the indicator arm;

a first switch assembly comprising a first switch unit having a lever, and a first cam unit having a first surface and configured to rotate about a cam axis to alternate between first and second positions, the first surface not contacting the lever so that the lever is disposed at a first position when the first cam unit rotates to the first position, the first surface contacting the lever and biasing the lever into a second position when the first cam unit rotates to the second position;

wherein as the indicator arm rotates from a first position to a second position, the striking member also rotates from a first position to a second position and momentarily exerts torque force on the first cam unit to cause the first cam unit to rotate from the first position to the second position, thereby causing the lever to move from the first position to the second position, the first cam unit being configured to maintain the second position without any external force other than the force exerted by the lever.

11. The apparatus of claim 10 wherein the first cam unit further comprises a second surface, the second surface contacting the lever when the cam unit is disposed at the first position.

12. The apparatus of claim 11 wherein the cam axis and the first surface have a first distance, while the cam axis and the second surface have a second distance, the first distance being different from the second distance.

13. The apparatus of claim 11 wherein the first and second surfaces comprise flat surfaces, the first and second surfaces meet to form a convex shape, the first and second surfaces being at an angle of about 60° to 120°.

14. The apparatus of claim 10 wherein the first switch unit further comprises an actuator that is inactivated when the lever is disposed at the first position, the actuator being activated when the lever is disposed at the second position.

15. The apparatus of claim 10, further comprising a second switch assembly having a second cam unit and a second switch unit, the second cam unit having a lever and having the same configuration as the first cam unit, the second switch unit having the same configuration as the first switch unit, wherein as the indicator arm rotates from the second position to a third position, the striking member also rotates from the second position to a third position and momentarily exerts torque force on the second cam unit to cause the second cam unit to rotate from a first position to a second position, thereby causing the lever of the second switch unit to move from a first position to a second position.

16. The apparatus of claim 15 wherein the first cam unit remains at the second position without exerting any force on the indicator arm or the striking member as the indicator arm and the striking member move from their second positions to their third positions, respectively.

17. The apparatus of claim 10 wherein the environment condition is temperature.

18. The apparatus of claim 17 wherein when the indicator arm rotates to the first and second positions, the indicator arm represents a first and a second temperature value, respectively.

19. The apparatus of claim 18 wherein when the indicator arm rotates to the second position, the lever is pushed by the first cam unit to move to the second position to activate the first switch unit to trigger an event.

20. The apparatus of claim 10 wherein the environment condition is air pressure.

* * * * *